US006018853A

United States Patent [19]

Chen et al.

[11] Patent Number: 6,018,853

[45] Date of Patent: Feb. 1, 2000

[54] KNOCKDOWN COFFIN STRUCTURE

[76] Inventors: Ting-Sheng Chen, 9F., No. 104, Shang-Hai Road Taoyuan, Taoyuan Hsien, Taiwan; Hsien-Chin Hsu, No. 106, Pao-Feng Street Pa-Te, Taoyuan Hsien, Taiwan

[21] Appl. No.: 09/159,874

[22] Filed: Sep. 24, 1998

[51] Int. Cl.[7] ..... A61G 17/00

[52] U.S. Cl. ..... 27/2; 27/4; 27/17; 220/4.28

[58] Field of Search ..... 27/2, 4, 17, 14, 27/19, 35; 220/4.28, 6

[56] References Cited

U.S. PATENT DOCUMENTS

| | | | |
|---|---|---|---|
| 117,800 | 8/1871 | Moore | 27/4 X |
| 304,113 | 8/1884 | Locher | 27/4 X |
| 2,964,210 | 12/1960 | Paley | 220/4.28 |
| 2,989,226 | 6/1961 | Swartz | 220/4.28 X |
| 3,371,816 | 3/1968 | Ricci | 220/4.28 |
| 3,618,805 | 11/1971 | Meller | 220/6 |
| 3,710,973 | 1/1973 | Franks | 220/4.28 |
| 3,784,043 | 1/1974 | Presnick | 220/4.28 |
| 4,402,397 | 9/1983 | Spence | 220/4.28 X |
| 4,800,631 | 1/1989 | Pellman | 27/2 X |
| 4,967,455 | 11/1990 | Elder | 27/4 |
| 5,586,679 | 12/1996 | Thomas | 27/4 |
| 5,770,291 | 6/1998 | Tambussi | 27/4 X |
| 5,771,549 | 6/1998 | Saaf | 27/4 |

*Primary Examiner*—Terry Lee Melius
*Assistant Examiner*—William L. Miller
*Attorney, Agent, or Firm*—Bacon & Thomas, PLLC

[57] ABSTRACT

A knockdown coffin structure includes a bottom plate made of a plurality of layers of paper sheet which has a honeycomb structure. The bottom plate has four edges, each having an arc slot coextensive therewith. Four side plates, made of a plurality of sheets of corrugated paper stacked over and adhered to each other and having an arc extension, are connected to the edges of the bottom plates by having the arc extensions thereof received in the arc slots of the bottom plate to such a position where the side plates are substantially perpendicular to the bottom plate. A holding plate is fit into coffin to be positioned on the bottom plate with edges of the holding plate abutting against and thus securely holding the side plates in the perpendicular position. The side plates also have rib-like projections. A cover plate is positioned on the side plates when the side plates are in the perpendicular position. The cover plate has grooves formed thereon to be corresponding to and receiving the rib-like projections therein so as to securely hold the side plates together. The side plates are readily detached from the bottom plate which renders the coffin a knockdown structure to facilitate warehousing and transportation of the coffin.

7 Claims, 7 Drawing Sheets

4A

KNOCKDOWN COFFIN STRUCTURE

BACKGROUND OF THE INVENTION

1. Field of the Invention

The present invention relates generally to a coffin structure and in particular to a knockdown coffin structure. More particularly, the present invention provides a knockdown coffin structure made of paper-based materials.

2. Related Arts

With the significant increase of human population, cremation is nowadays a better choice for handling dead body. Cremation may need a coffin, usually made of wood, to substantially hermetically hold the dead body therein for sanitary purpose, especially in areas where no body freezing device is readily available. Using the wood coffin to contain dead body to be cremated has some disadvantages, such as:

(1) The manufacture of the wood coffin requires skilled coffin makers.

(2) The configuration of the wood coffin that may be available in the market is usually fixed and the consumers have no much choice in selecting different coffins.

(3) The wood coffin is in general heave which renders it difficult to move, resulting in high transportation cost.

(4) The parts of the wood coffin are usually fixed together by means of metal nails or metal pieces which cannot be handled easily for cremation.

(5) The wood coffin, once completed may not be disassembled and re-assembled easily so that it usually occupies a great space in transportation and warehousing.

It is thus desirable to provide a paper-made knockdown coffin structure to overcome the problems encountered in the prior art.

SUMMARY OF THE INVENTION

Thus, a principal object of the present invention is to provide a knockdown coffin structure which is ready to assemble/disassemble without special skill.

Another object of the present invention is to provide a coffin made of paper-based material for environment protection.

A further object of the present invention is to provide a coffin structure which allows people to select the outside surface decoration and patterns.

A further object of the present invention is to provide a coffin structure which consists of no metal parts so as to be most suitable for cremation.

A further object of the present invention is to provide a light-weighted coffin structure for enhancing the transportation thereof so as to cut down the transportation expense.

Yet a further object of the present invention is to provide a coffin having a knockdown structure which may be collapsed in stowing the coffin so as to reduce the space occupied by the coffin during warehousing and transportation.

In accordance with the present invention, there is provided a knockdown coffin structure, comprising a bottom plate made of a plurality of layers of paper sheet which has a honeycomb structure. The bottom plate has four edges, each having an arc slot coextensive therewith. Four side plates, made of a plurality of sheets of corrugated paper stacked over and adhered to each other and having an arc extension, are connected to the edges of the bottom plates by having the arc extensions thereof received in the arc slots of the bottom plate to such a position where the side plates are substantially perpendicular to the bottom plate. A holding plate is fit into coffin to be positioned on the bottom plate with edges of the holding plate abutting against and thus securely holding the side plates in the perpendicular position. The side plates also have rib-like projections. A cover plate is positioned on the side plates when the side plates are in the perpendicular position. The cover plate has grooves formed thereon to be corresponding to and receiving the rib-like projections therein so as to securely hold the side plates together. The side plates are readily detached from the bottom plate which renders the coffin a knockdown structure to facilitate warehousing and transportation of the coffin.

BRIEF DESCRIPTION OF THE DRAWINGS

The present invention will be better understood from the following description of a preferred embodiment thereof, with reference to the attached drawings, wherein:

FIG. 4A is an enlarged view of the circled portion A in FIG. 4;

DETAILED DESCRIPTION OF THE PREFERRED EMBODIMENT

Figure 1:
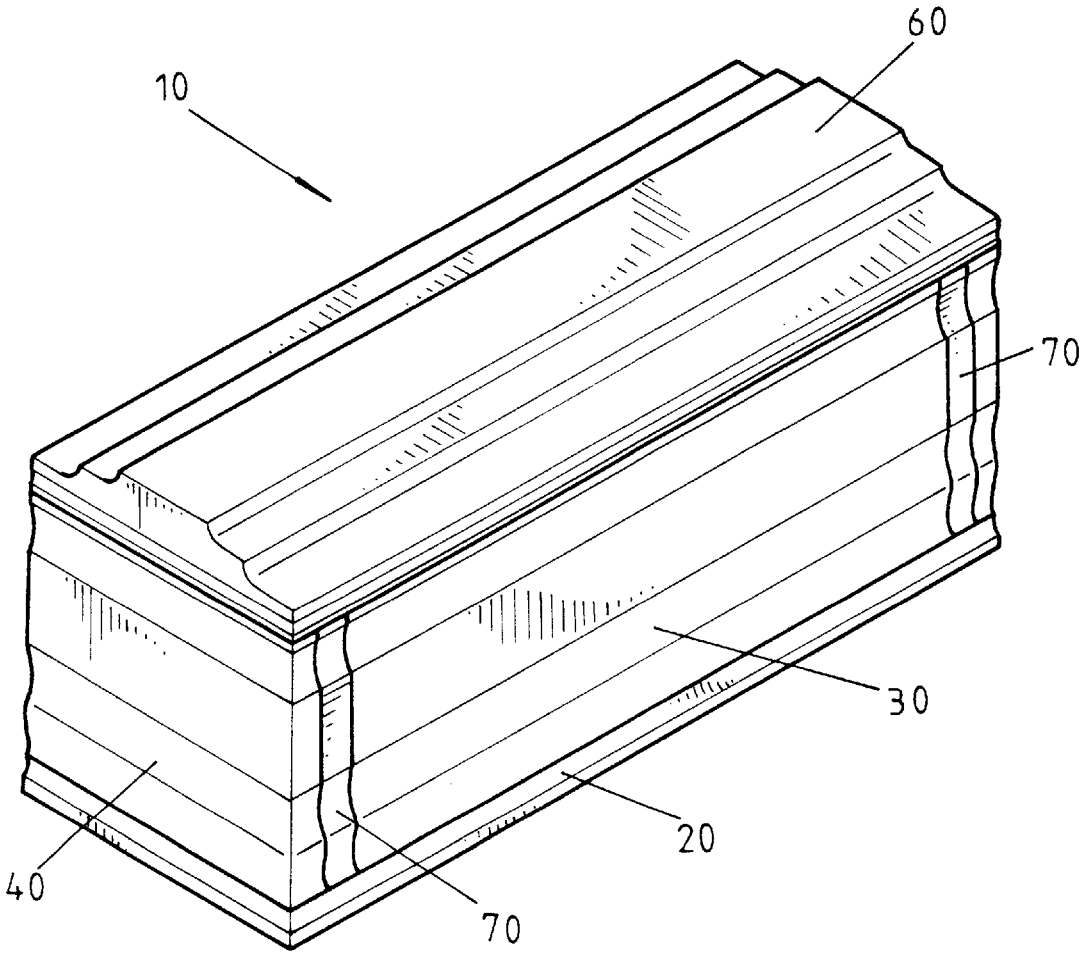
FIG. 1 is a perspective view showing a knockdown coffin constructed in accordance with the present invention.
Figure 2:
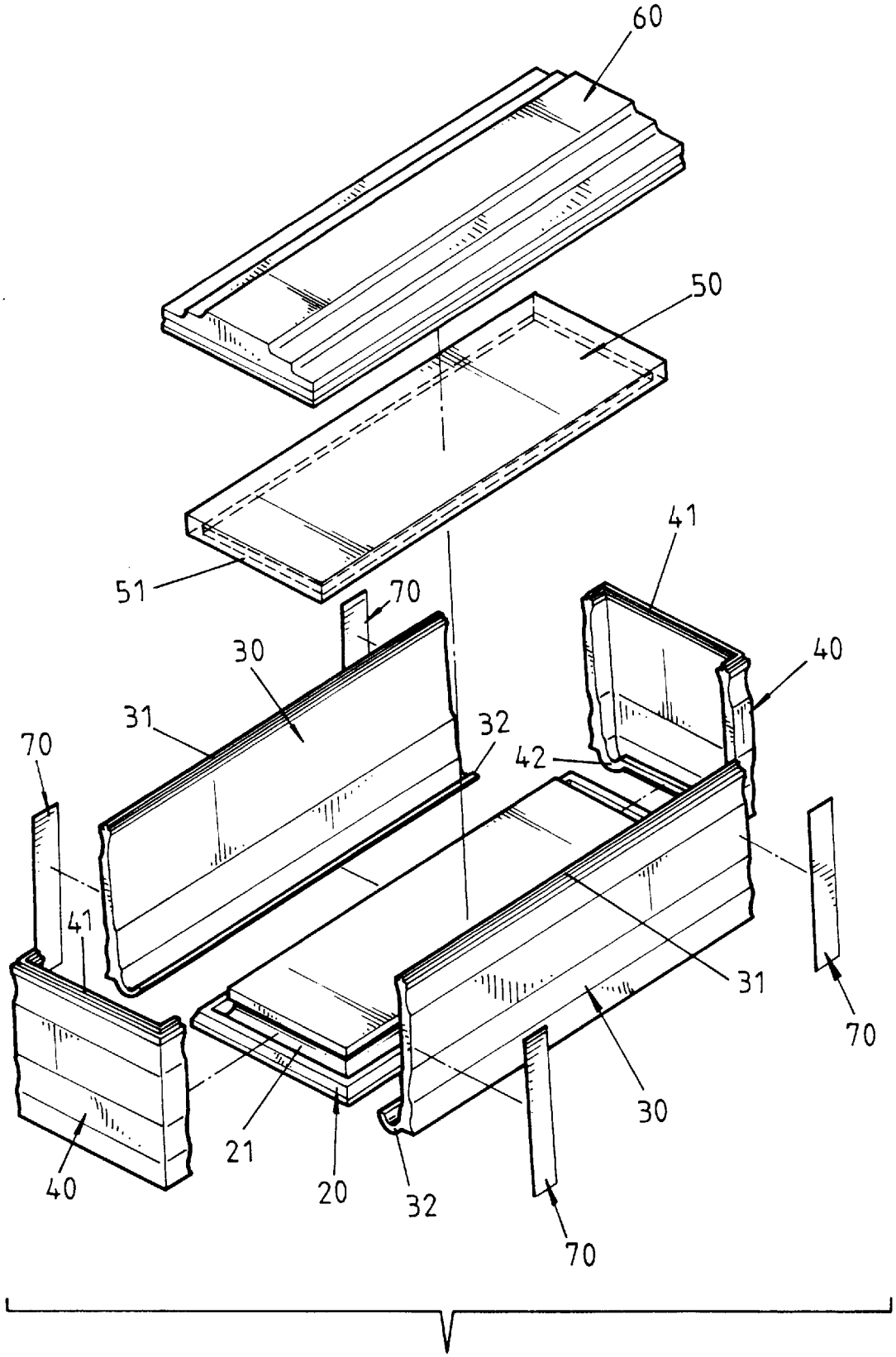
FIG. 2 is an exploded perspective view of the knockdown coffin.

With reference to the drawings and in particular to FIGS. 1 and 2, wherein a knockdown coffin structure in accordance with the present invention, generally designated with reference numeral 10, is shown, the coffin 10 comprises a bottom plate 20, two long side plates 30, two short side plates 40, a holding plate 50 and a cover plate 60 with the long side plates 30 and the short side plates 40 extending between the cover plate 60 and the bottom plate 20 to define an interior space or receptacle for receiving a dead body (not shown).

As shown in FIG. 2, the bottom plate 20 is a rectangular plate-like member having four edges along which a slot 21 is formed and coextensive therewith. The slot 21 has an arc cross section having an end extending into the bottom plate 20 substantially in a direction normal to the edge of the bottom plate 20.

In accordance with the present invention, the bottom plate 20 may be made of a plurality of paper sheets having a special honeycomb structure adhered together in a multiple layer fashion. Such a honeycomb structure of the paper sheets that are adhered together to form the bottom plate 20 provides a sufficient structural strength. Quite obviously, the bottom plate 20 may be made of other material, provided it has a sufficient structural strength to support the dead body disposed inside the coffin 10.

The two long side plates 30 and the two short side plates 40 are respectively mounted to two opposite first edges and two opposite second edges of the four edges of the bottom plate 20. Each of the long side plate 30 has a hook or arc extension 32 formed on a lower edge of the long side plate 30 and matingly receivable in the arc slot 21 of the respective edge of the bottom plate 20. The arc configuration of the slot 21 of the bottom plate 20 and the mated arc extension 32 of the associated long side plate 30 allow the long side plate 30 to be rotatable with respect to the bottom plate 20 about a center point of the arc configuration of the slot 21 and the arc extension 32 so as to have the arc extension 32 to slide with respect to the arc slot 21 of the bottom plate 20 for being completely received in the arc slot 21 to such a position where the long side plate 30 is substantially perpendicular to the bottom plate 20 as shown in FIG. 2. The relative sliding movement of the arc extension 32 of the long side plate 30 also allows the arc extension 32 to be withdrawn out of the arc slot 21 of the bottom plate 20 so as to detach the long side plate 30 from the bottom plate 20 in collapsing the coffin 10.

The long side plate 30 also has an elongated rib-like projection 31 formed on and coextensive with the upper edge of the long side plate 30 so as to be substantially opposite to the arc extension 32.

Each of the short side plates 40 has an arc extension 42 receivable within the arc slot 21 of the associated edge of the bottom plate 20 to such a position that the short side plate 40 is substantially perpendicular to the bottom plate 20. The arc extension 42 of the short side plate 40 is slidable with respect to the arc slot 21 so as to have the arc extension 42 of the short side plate 40 withdrawn out of the arc slot 21 of the bottom plate 20 and thus the short side plate 40 is detached from the bottom plate 20 in collapsing the coffin 10.

Figure 4:
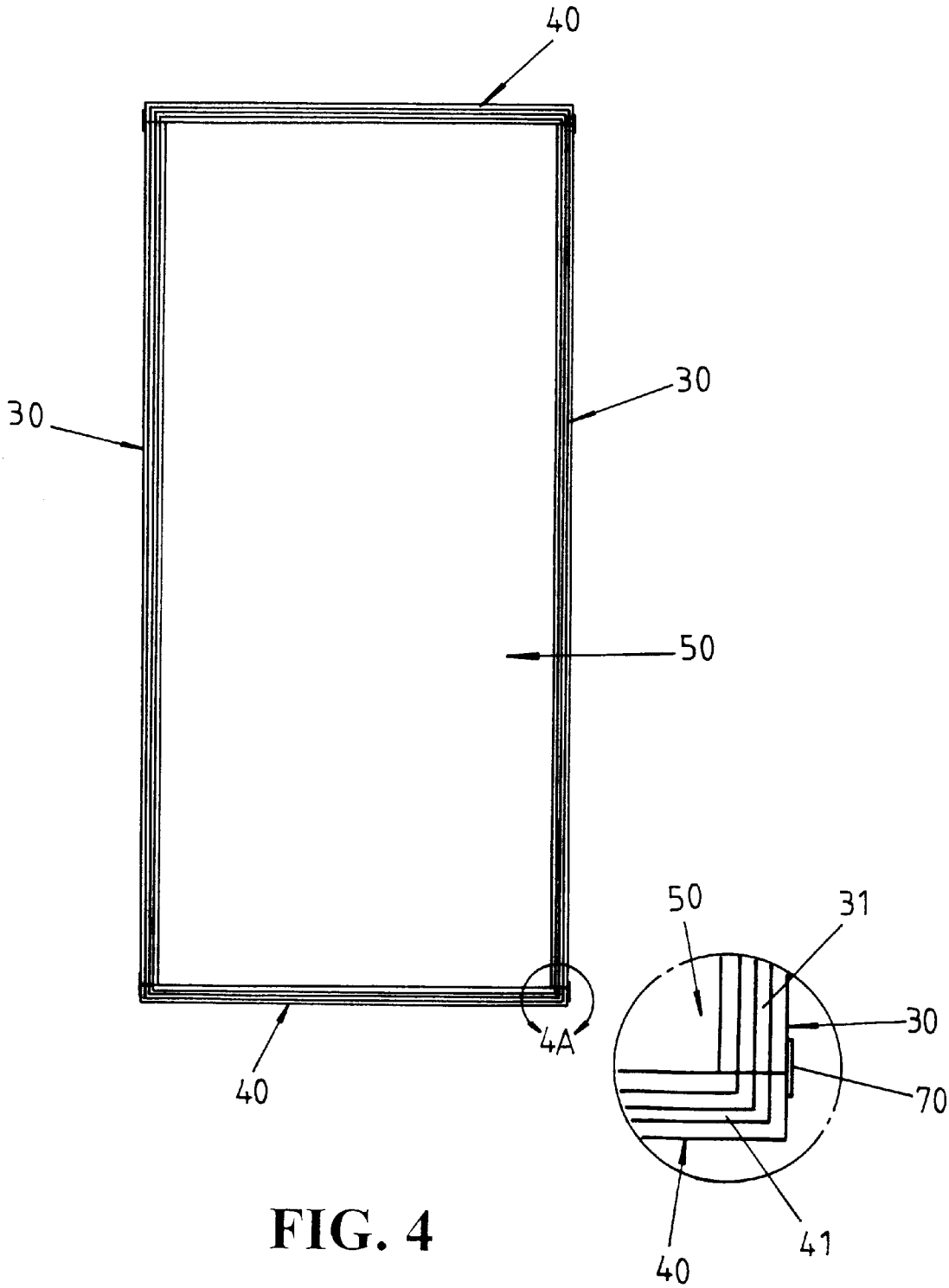
FIG. 4 is a top plan view of the knockdown coffin with the cover plate removed.

The short side plate 40 also has two lateral side extensions from opposite lateral side edges thereof to matingly engage lateral side edges of the long side plates 30 when the long and short side plates 30 and 40 are in the expanded condition where they are substantially perpendicular to the bottom plate 20 as shown in FIGS. 4 and 4A.

The short side plate 40 also has an elongated rib-like projection 41 formed on and coextensive with the upper edge of the short side plate 30 so as to be substantially opposite to the arc extension 32. Preferably, the rib-like projection 41 also extends over the lateral side extensions of the short side plate 40 so that when the side plates 30 and 40 are in the expanded condition, the portions of the projection 41 that are located on the lateral side extensions of the short side plate 40 are respectively coincident with and in alignment with the projections 31 of the two long side plates 30 so that the rib-like projections 31 and 41 of the long and short side plates 30 and 40 may completely surround the top side of the coffin 10 when the side plates 30 and 40 are in the expanded condition.

In accordance with the preferred embodiment of the present invention, the side plates 30 and 40 are preferably made of a plurality of corrugated paper sheets which are glued or adhered together to provide a desired structural strength and rigidity. Quite obviously, the side plates 30 and 40 may be made of other materials, provided they may have sufficient structural strength and rigidity.

The holding plate 50 is a rectangular plate which has a circumferential flange 51 extending from the circumferential edges thereof and substantially perpendicular thereto, sized to be fit a gap between each of the side plates 30 and 40 and the respective edge of the bottom plate 20 to abut against and thus more securely hold the side plates 30 and 40 in the upright, expanded condition.

The cover plate 60 is a rectangular plate substantially corresponding in size and shape to the bottom plate 20, having four edges. The cover plate 60 has formed on an inner surface which faces the bottom plate 20 in the assembled condition a groove 61 inboard each of the edges. The grooves 61 are sized and positioned to receive the rib-like projections 31 and 41 of the side plates 30 and 40 therein for supporting and holding the cover plate 60 on the side plates 30 and 40 and securing the side plates 30 and 40 together.

Figure 3:
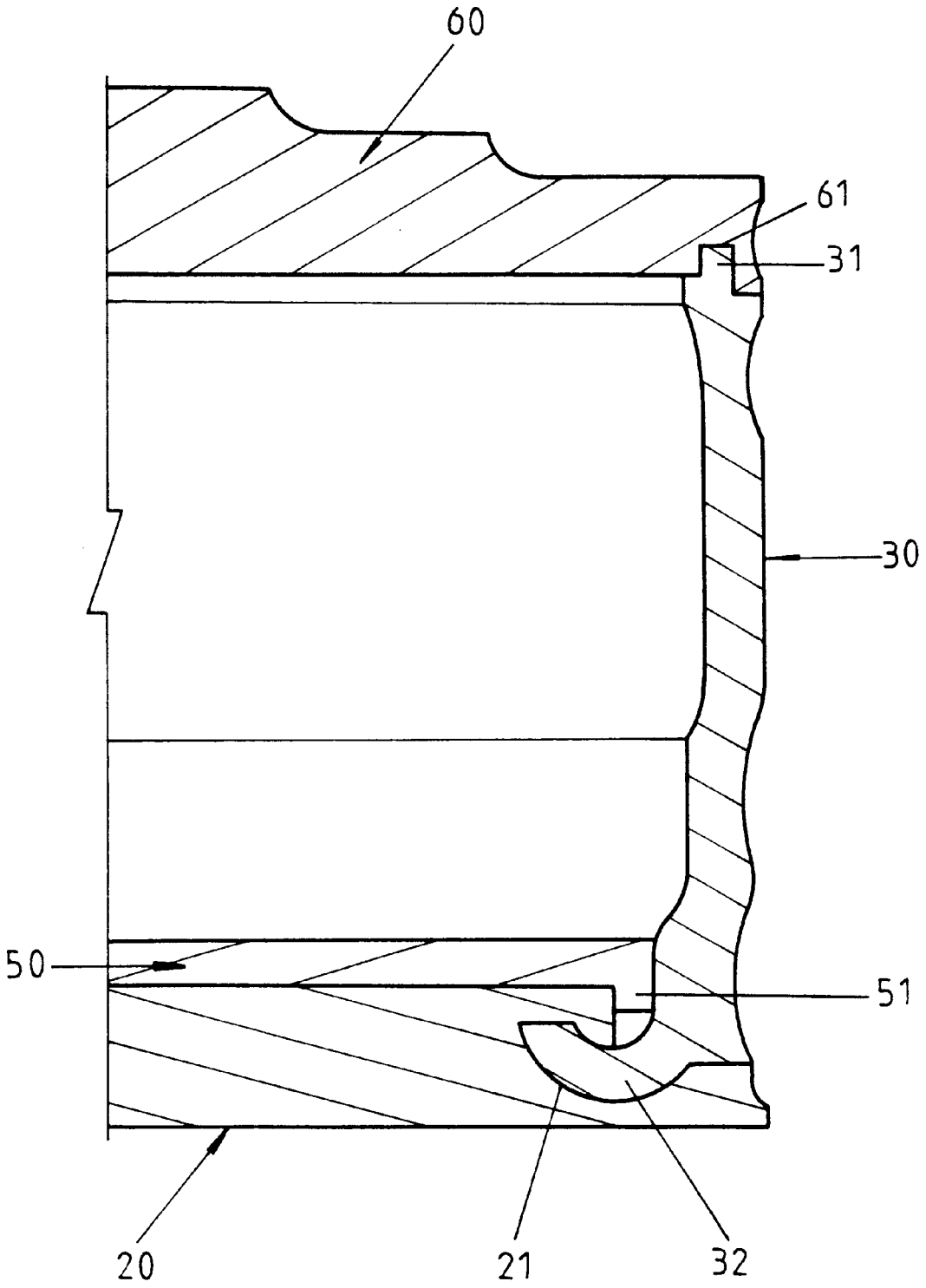
FIG. 3 is a cross-sectional view of a portion of the knockdown coffin.

FIGS. 3 and 4 respectively show a cross-sectional view of a portion of the coffin 10 in the assembled condition and a top plan view of the coffin 10 with the cover plate 60 removed to illustrate the spatial relationship between the plates 20, 30, 40, 50 and 60. In assembling the coffin 10, the arc extensions 32 and 42 of the long and short side plates 30 and 40 are inserted into the corresponding arc slots 21 of the bottom plate 20, preferably with the bottom plate 20 laid on a flat stationary surface, such as the ground. The arc extensions 32 and 42 are fit into the arc slots 21 to such a position where the side plates 30 and 40 are substantially perpendicular to the bottom plate 20 as shown in FIG. 3. The holding plate 50 is then put into the coffin 10 and positioned on the bottom plate 20 with the flange 51 thereof fit into the gaps between the side plates 30, 40 and the bottom plate 20 so as to securely hold the side plates 30 and 40 in the perpendicular position. The cover plate 60 is then positioned on the side plates 30 and 40 with the rib-like projections 31 and 41 of the side plates 30 and 40 properly received into the grooves 61 of the cover plate 60. This securely holds all the plate members 20, 30, 40, 50 and 60 together to form the coffin 10.

Figure 6:
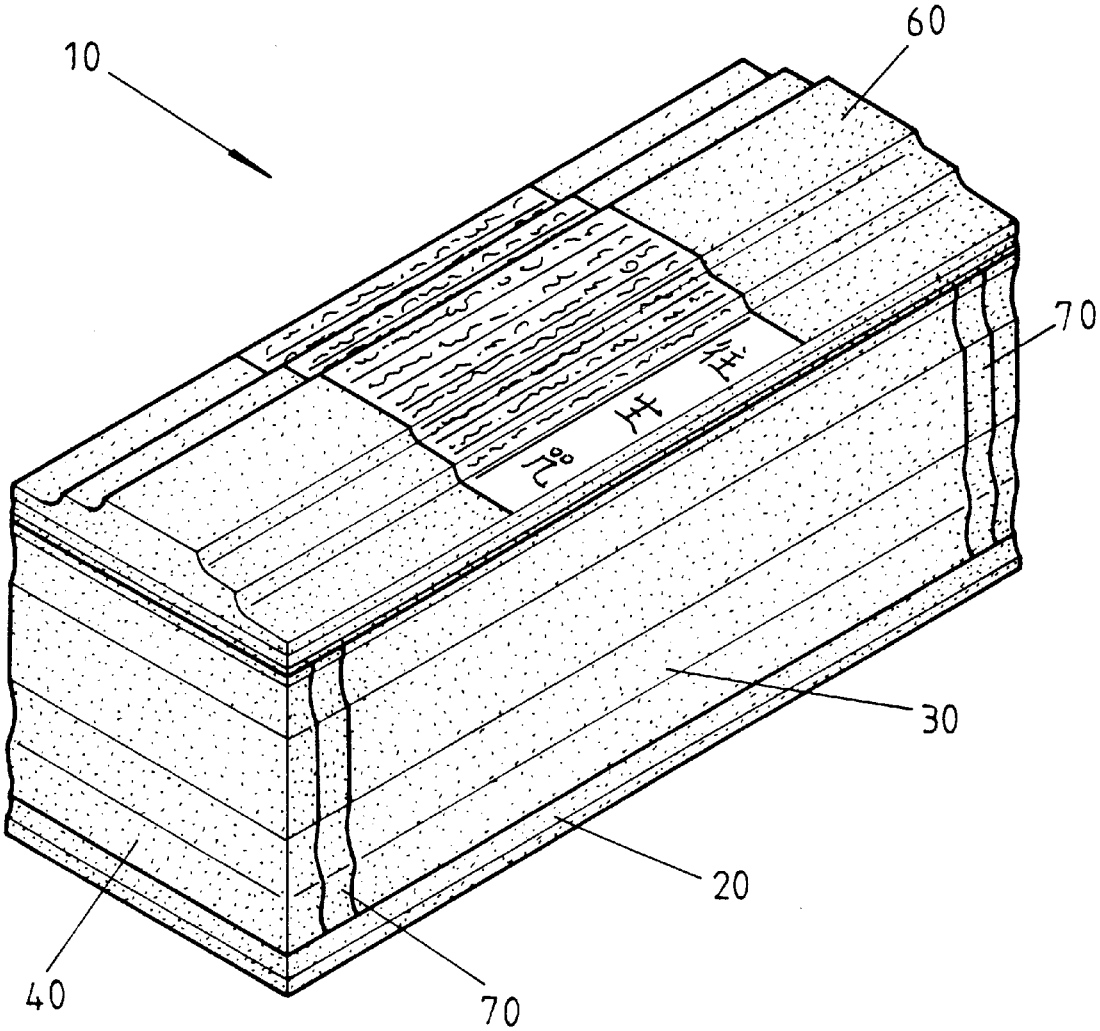
FIGS. 6 and 7 are perspective views of the knockdown coffin, respectively showing the knockdown coffin with different outside surface decorations.
Figure 7:
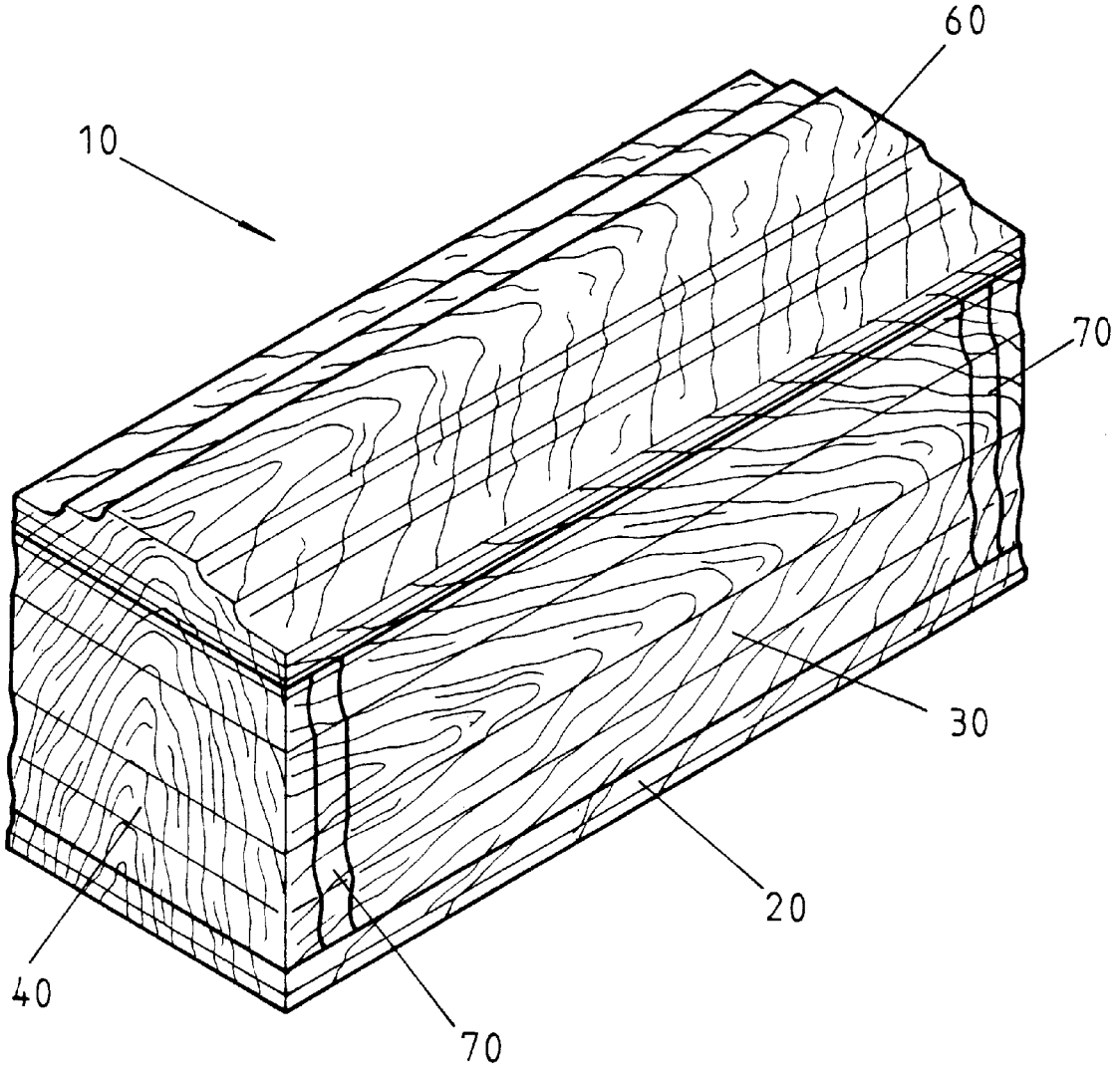

Surface decoration sheets or films 70, see FIGS. 6 and 7 which show different embodiments of the surface decoration films 70, may then be attached to the outside surfaces of the plate members 20, 30, 40 and 60 for decorating and further strengthening the coffin structure. People may select surface decoration films 70 with desired patterns so that the coffin 10 may look more dignified and more solemn.

Figure 5:
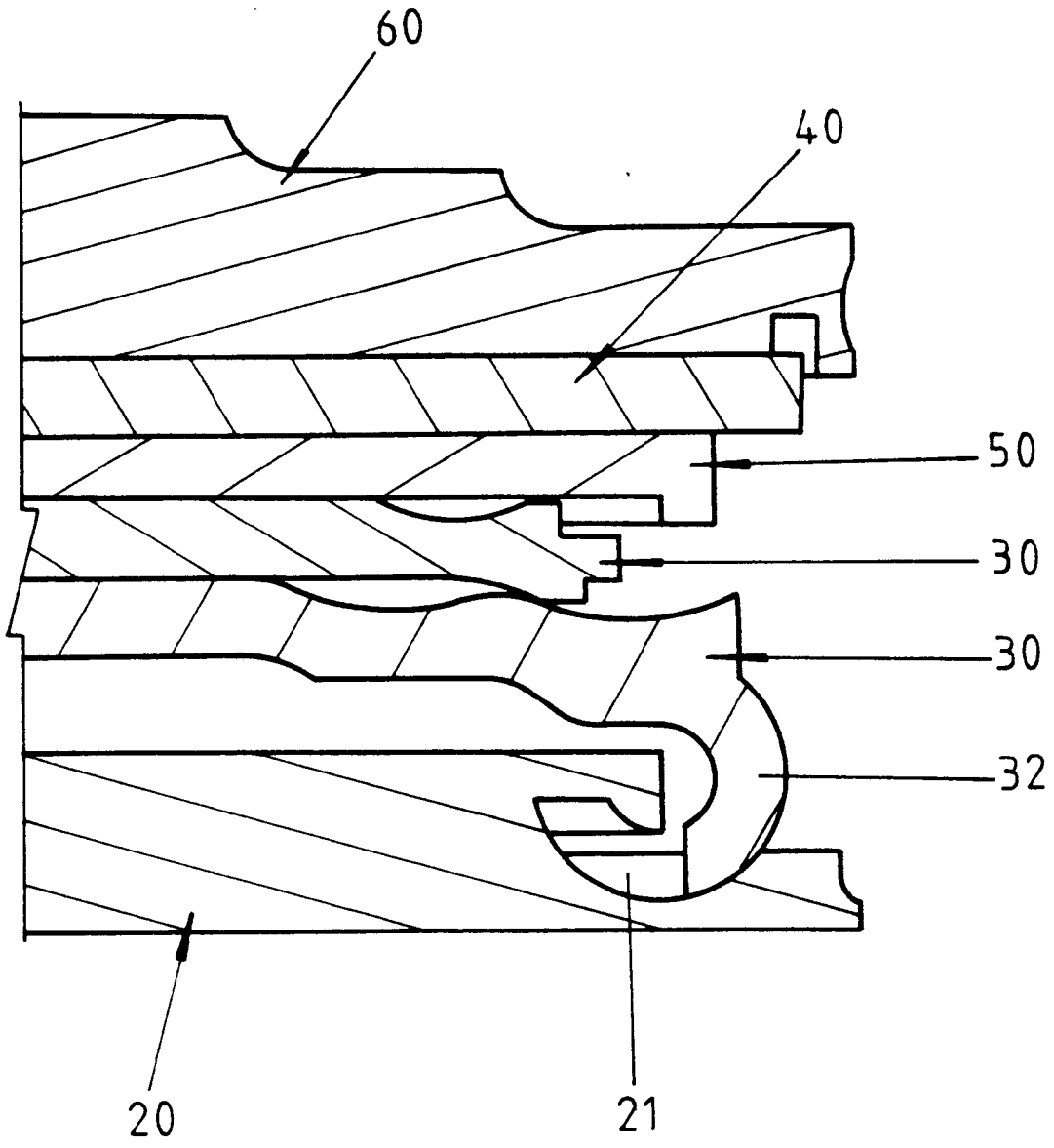
FIG. 5 is a cross-sectional view of the coffin in a disassembled and collapsed condition.

FIG. 5 demonstrates one way for stowing the coffin 10 in a collapsed condition. To disassemble and collapse the coffin structure 10, one may first remove the cover plate 60 from the coffin 10 to expose the holding plate 50 which is then taken out of the coffin 10 to release the short and long side plates 30 and 40. Thereafter, the side plates 30 and 40 may be detached from the bottom plate 20 by having the arc extensions 32 and 42 of the side plates 30 and 40 sliding with respect to the arc slots 21 of the bottom plate 20. The long side plates 30, the holding plate 50, the short plates 40 and the cover plate 60 may then be sequentially stacked on the bottom plate 20 as shown in FIG. 5. Of course, these plates 20, 30, 40, 50 and 60 may be stacked over each other in different sequences and different ways. By this way, the coffin 10 may be stowed and transported in a more space efficient manner and the assemblage of the coffin 10 requires no professional skilled person to work on it.

The knockdown coffin structure in accordance with the present invention provides the following advantages:

(1) The coffin may be readily assembled/disassembled by non-skilled persons and the assembled coffin has a strong and firm structure.

(2) The outside surface of the coffin may be decorated with any desired patterns and articles.

(3) The coffin structure is light-weighted, if made of the paper based materials discussed herein, so that it is ready to move and the transportation cost may be reduced.

(4) The whole structure of the coffin comprises no metal parts, if made of the materials discussed herein, so that it is most suitable for cremation.

(5) The knockdown structure makes it possible to transport and stow in a space efficient manner.

Although a preferred embodiment has been described to illustrate the present invention, yet for those skilled in the art, it is possible to make a variety of modifications and changes to the specific embodiment without departing from the scope and spirit of the present invention. All these modifications and changes should be considered within the scope of the present invention as defined in the appended claims.

What is claimed is:

1. A knockdown coffin comprising:

a rectangular bottom plate having two opposite first edges and two opposite second edges, each of the edges having an arc slot formed thereon and coextensive therewith;

two long side plates respectively associated with the first edges of the bottom plate, each of the long side plates having a lower edge with arc extension formed thereon to be slidably receivable into the arc slot of the respective first edge of the bottom plate to such a position where the long side plate is substantially perpendicular to the bottom plate, the long side plate also having an upper edge on which a rib-like projection is formed and coextensive therewith;

two short side plates respectively associated with the second edges of the bottom plate, each of the short side plates having a lower edge with arc extension formed thereon to be slidably receivable into the arc slot of the respective second edge of the bottom plate to such a position where the short side plate is substantially perpendicular to the bottom plate so that the short and long side plates and the bottom plate define a receptacle adapted to receive therein a dead body, the short side plate also having an upper edge on which a rib-like projection is formed and coextensive therewith;

a holding plate which is fit into the receptacle to be positioned on the bottom plate with edges of the holding plate abutting against and thus holding the long and short side plates in the perpendicular position;

a cover plate positionable on the short and long side plates when the short and long side plates are in the perpendicular position, the cover plate having grooves formed thereon to receive the rib-like projections of the short and long side plates therein for securing the short and long side plates together; and wherein the short and long side plates are connected to the edges of the bottom plate by having the arc extensions thereof received in the arc slots of the bottom plate in such a way to form a gap between each of the side plates and the respective edge of the bottom plate and wherein the holding plate comprises a flange formed on each of the edges thereof to be fit into the gap of the respective side plates for securely holding the side plate in the perpendicular position.

2. The knockdown coffin as claimed in claim 1, further comprising outside surface decoration films to be selectively attached to outside surfaces of the cover plate, the short and long side plates and the bottom plate.

3. The knockdown coffin as claimed in claim 1, wherein the cover plate, the short and long side plates, the bottom plate and the holding plate are made of light-weighted inflammable material.

4. The knockdown coffin as claimed in claim 3, wherein the light-weighted inflammable material comprises paper-based material.

5. The knockdown coffin as claimed in claim 4, wherein the side plates are made of a plurality of corrugated paper sheets which are adhered together in a multiple layer fashion.

6. The knockdown coffin as claimed in claim 4, wherein the bottom plate is made of a plurality of paper sheets adhered together in a multiple layer fashion, the paper sheets comprising a honeycomb structure.

7. The knockdown coffin as claimed in claim 1, wherein each of the short side plates has two opposite lateral edges, each having an extension to be in contact engagement with edges of the long side plates when the short and long side plates are in the perpendicular position.

* * * * *